US011198212B1

(12) United States Patent
Lee

(10) Patent No.: US 11,198,212 B1
(45) Date of Patent: Dec. 14, 2021

(54) EXPLOSIVE DISCHARGE ACTUATED TOOL FOR DRIVING FASTENERS

(71) Applicant: Chung-Yi Lee, New Taipei (TW)

(72) Inventor: Chung-Yi Lee, New Taipei (TW)

( * ) Notice: Subject to any disclaimer, the term of this patent is extended or adjusted under 35 U.S.C. 154(b) by 0 days.

(21) Appl. No.: 17/039,677

(22) Filed: Sep. 30, 2020

(51) Int. Cl.
*B25C 1/18* (2006.01)
*B25C 1/14* (2006.01)

(52) U.S. Cl.
CPC ..... *B25C 1/186* (2013.01); *B25C 1/143* (2013.01)

(58) Field of Classification Search
CPC ..... B25C 1/18; B25C 1/182; B25C 1/186; B25C 1/143
See application file for complete search history.

(56) References Cited

U.S. PATENT DOCUMENTS 3,565,313 A * 2/1971 Hans-Dieter ..... B25C 1/105 227/10
4,804,127 A * 2/1989 Kirkman ..... B25C 1/143 227/10
6,547,120 B1 * 4/2003 Popovich ..... B25C 1/186 227/10
6,981,630 B2 * 1/2006 Popovich ..... B25C 1/186 227/10
7,575,139 B2 * 8/2009 Thompson ..... B25C 1/10 227/10
8,960,517 B2 * 2/2015 Lee ..... B25C 1/143 227/10
2003/0019902 A1 * 1/2003 Popovich ..... B25C 1/186 227/10
2005/0035172 A1 * 2/2005 Popovich ..... B25C 1/186 227/10
2012/0037683 A1 * 2/2012 Lee ..... B25C 1/188 227/10

* cited by examiner

*Primary Examiner* — Andrew M Tecco
(74) *Attorney, Agent, or Firm* — Hamre, Schumann, Mueller & Larson, P.C.

(57) ABSTRACT

An explosive discharge actuated tool is used with a multi-cartridge strip for driving fasteners, and includes a tool housing, a firing module disposed within the tool housing and rearwardly of a firing position, and a trigger and cartridge advancing module coupled with the firing module such that turning of a trigger lever causes turning of a cartridge advancing lever to move the strip so as to move a next cartridge to the firing position during the cartridge detonation in the firing position.

6 Claims, 8 Drawing Sheets

EXPLOSIVE DISCHARGE ACTUATED TOOL FOR DRIVING FASTENERS

FIELD

The disclosure relates to an explosive discharge actuated tool for driving fasteners, and more particularly to an explosive discharge actuated tool used with a multi-cartridge strip.

BACKGROUND

A conventional explosive discharge actuated tool drives fasteners by detonating a cartridge loaded therein to release explosive gas pressure. After detonation of a cartridge, a next cartridge should be loaded to a firing position prepared for the next detonation. For example, referring to FIG. 1, U.S. Pat. No. 8,960,517 discloses a fastener-driving device with a manually operated load-feeding mechanism which is driven to move a next cartridge on a strip to a firing position. The load-feeding mechanism is connected with a long pushing rod 4 which is at the rear end of an inner tube 5 such that the forward and rearward movements of the inner tube 5 relative to an external sleeve 6 result in feeding of the cartridges. However, the inner tube 5 is liable to be deviated relative to the external sleeve 6 during the forward and rearward movements due to the clearance 7 therebetween, which results in much more deviation at the end of the long pushing rod 4 as the deviation is proportionally enlarged. Therefore, the deviation of a load advancer position is enlarged accordingly, which results in the difficulty of stable and correct load advancing function.

SUMMARY

Therefore, an object of the disclosure is to provide an explosive discharge actuated tool that can alleviate at least one of the drawbacks of the prior art.

According to the disclosure, the explosive discharge actuated tool is used with a multi-cartridge strip for driving fasteners. The multi-cartridge strip includes a strip body and multiple cartridges loaded on the strip body. The strip body has multiple side notches respectively corresponding to the cartridges. The explosive discharge actuated tool includes a tool housing, a firing module, and a trigger and cartridge advancing module. The tool housing has a strip accommodation channel which extends in an upright direction for accommodating the strip. The strip accommodation channel has a firing position where a cartridge to be detonated is loaded. The firing module is disposed within the tool housing, and is located rearwardly of the firing position. The trigger and cartridge advancing module includes a mounting frame, a firing igniting lever, a cartridge advancing lever, a link bar, a trigger and a biasing returning member. The mounting frame is disposed securely within the tool housing. The trigger lever is pivotably attached to the mounting frame. The cartridge advancing lever is pivotably attached to the mounting frame and has a strip-engage end which is turnable to be fitted to one of the side notches that corresponds to the cartridge in the firing position. The link bar is pivotably connected between the trigger lever and the cartridge advancing lever such that turning of the trigger lever causes turning of the cartridge advancing lever. The trigger is disposed to be pulled to turn the trigger lever to drive the firing module into the cartridge in the firing position, and, through the link bar, to turn the cartridge advancing lever so as to move the strip-engage end to engage with a next one of the side notches that corresponds to the next cartridge. The biasing returning member is disposed to bias the cartridge advancing lever, the link bar, the trigger lever and the trigger to return to their original positions, and to result in, during returning of the cartridge advancing lever, an upward and advancing movement of the strip-engage end and the strip so as to move the next cartridge to the firing position. The mounting frame has a guideway which penetrates in a front-and-rear direction that is transverse to the upright direction and which is elongated in the upright direction. The trigger lever has a guided portion which is fittingly extended through the guideway to stabilize the turning of the trigger lever.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
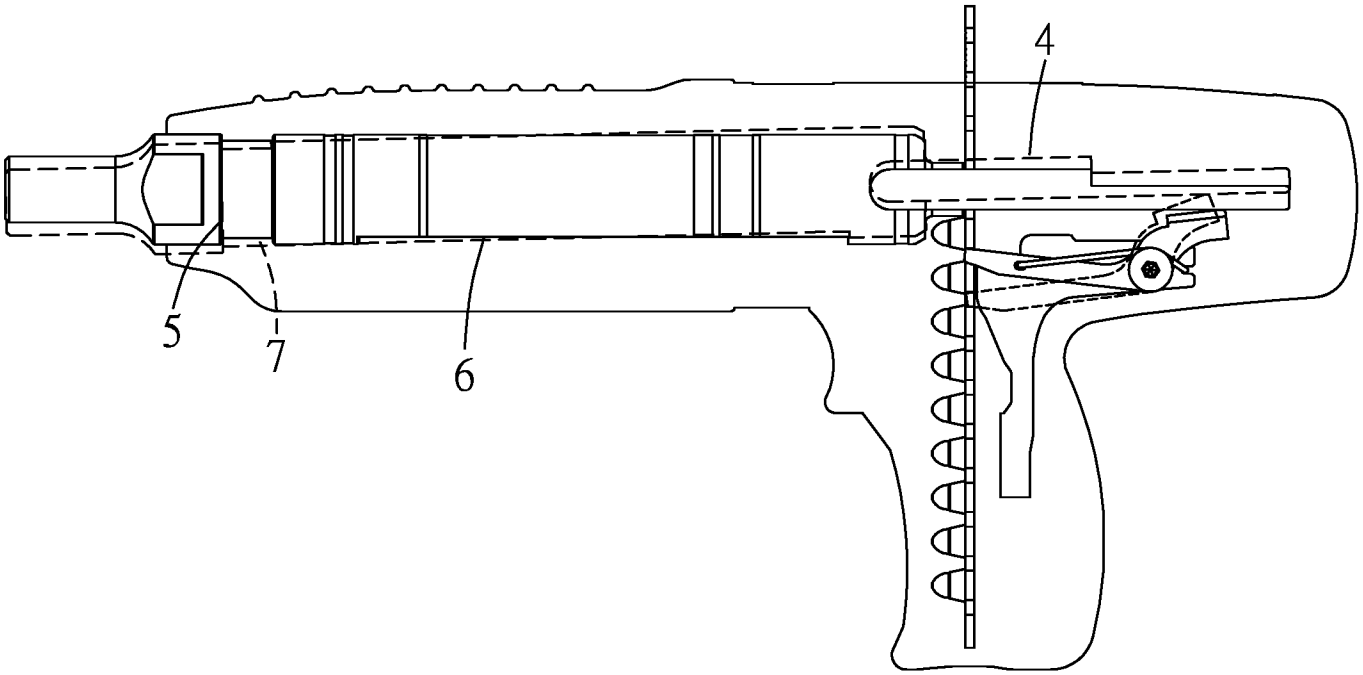
FIG. 1 PRIOR ART
FIG. 1 is a schematic side view of a conventional powder-actuated fastener-driving device.
Figure 2:
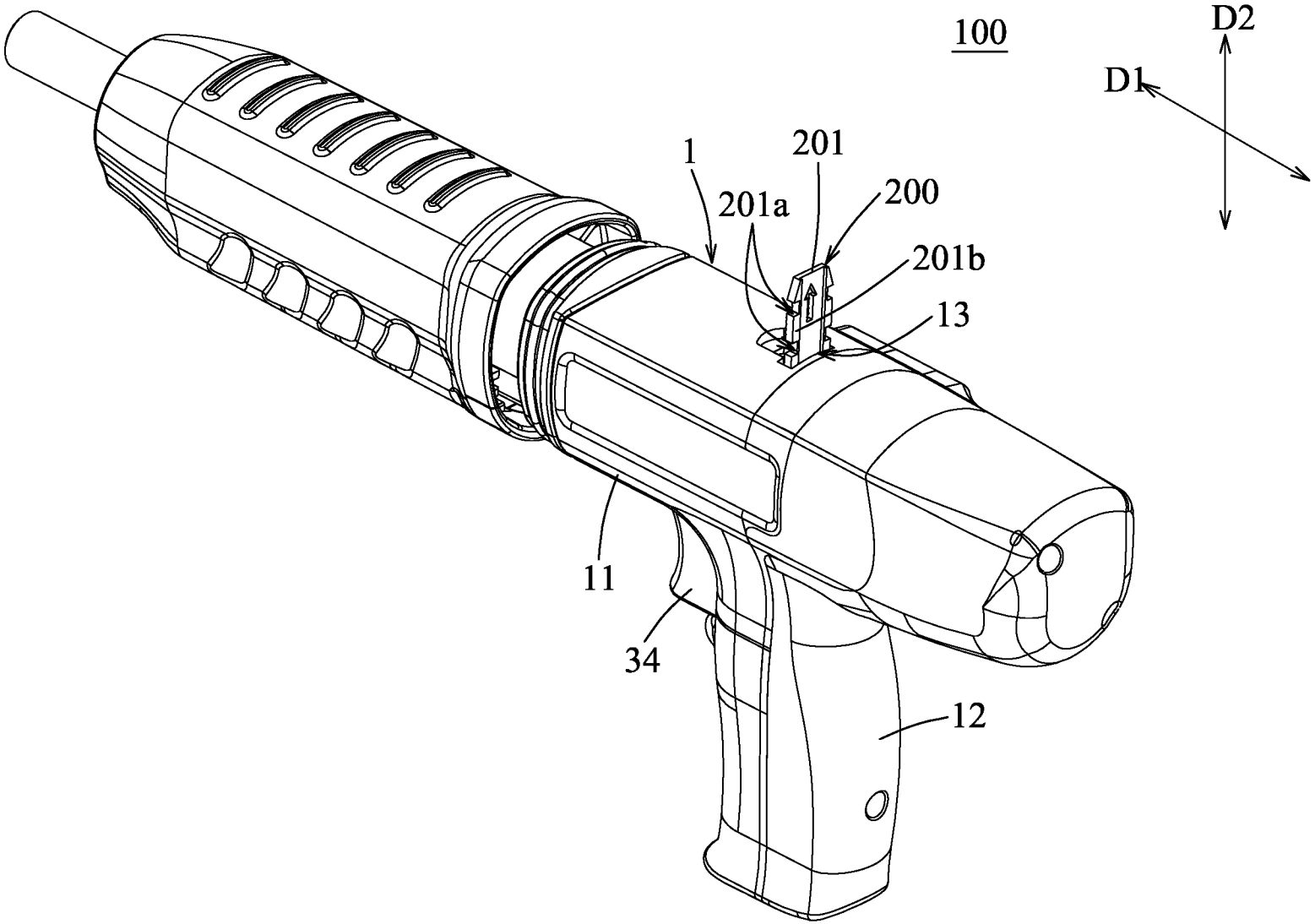
FIG. 2 is a perspective view illustrating an embodiment of an explosive discharge actuated tool according to the disclosure.
Figure 3:
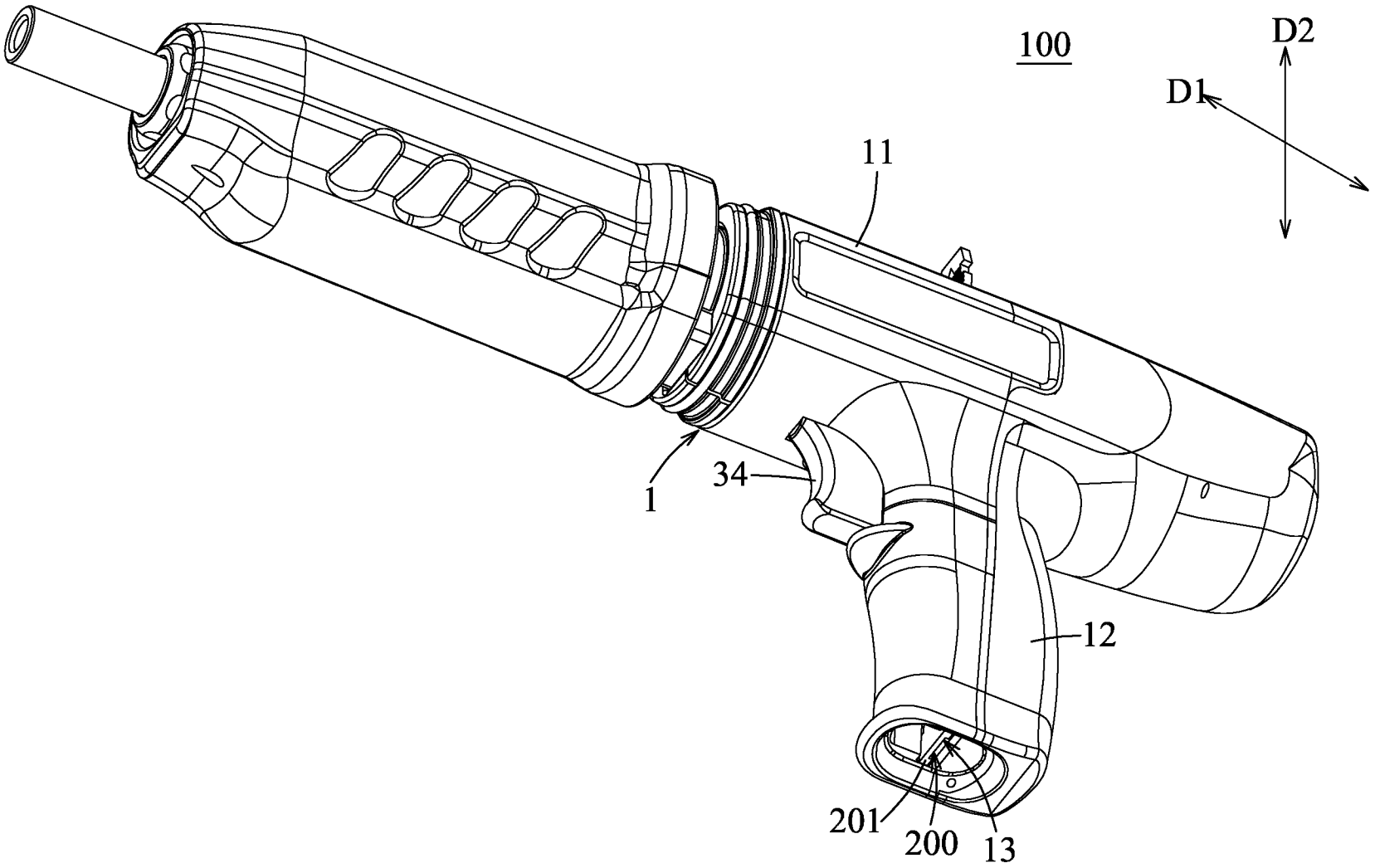
FIG. 3 is a perspective view of the embodiment taken from another angle.
Figure 4:
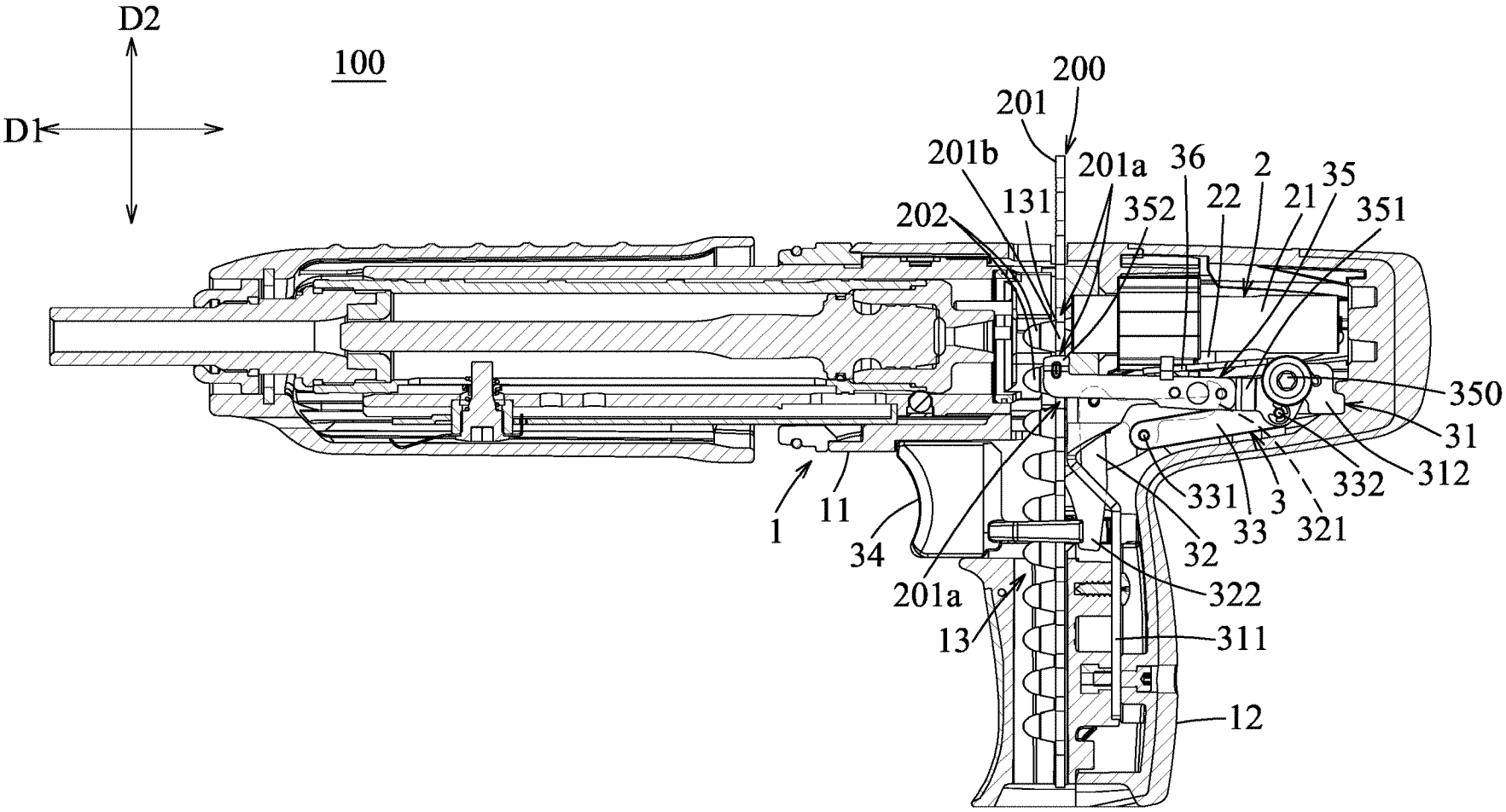
FIG. 4 is a partly sectional view of the embodiment.

Referring to FIGS. 2 to 4, an embodiment of an explosive discharge actuated tool 100 according to the disclosure is utilized with a multi-cartridge strip 200 for driving fasteners (not shown). The multi-cartridge strip 200 includes a strip body 201 and multiple cartridges 202 loaded on the strip body 201. The strip body 201 has, at two sides thereof, multiple side notches (201*a*) respectively corresponding to the cartridges 202. The explosive discharge actuated tool 100 includes a tool housing 1, a firing module 2, and a trigger and cartridge advancing module 3.

The tool housing 1, in this embodiment, has a gun profile, and has a main tube section 11 extending in a front-and-rear direction (D1), and a grip section 12 extending downwardly from a bottom portion of the main tube section 11 in an upright direction (D2) that is transverse to the front-and-rear direction (D1) and having a strip accommodation channel 13 which extends in the upright direction (D2) for accommodating the strip 200. The strip accommodation channel 13 has a firing position 131 which is defined in the main tube section 11 where the cartridge 202 to be detonated is loaded.

Figure 6:
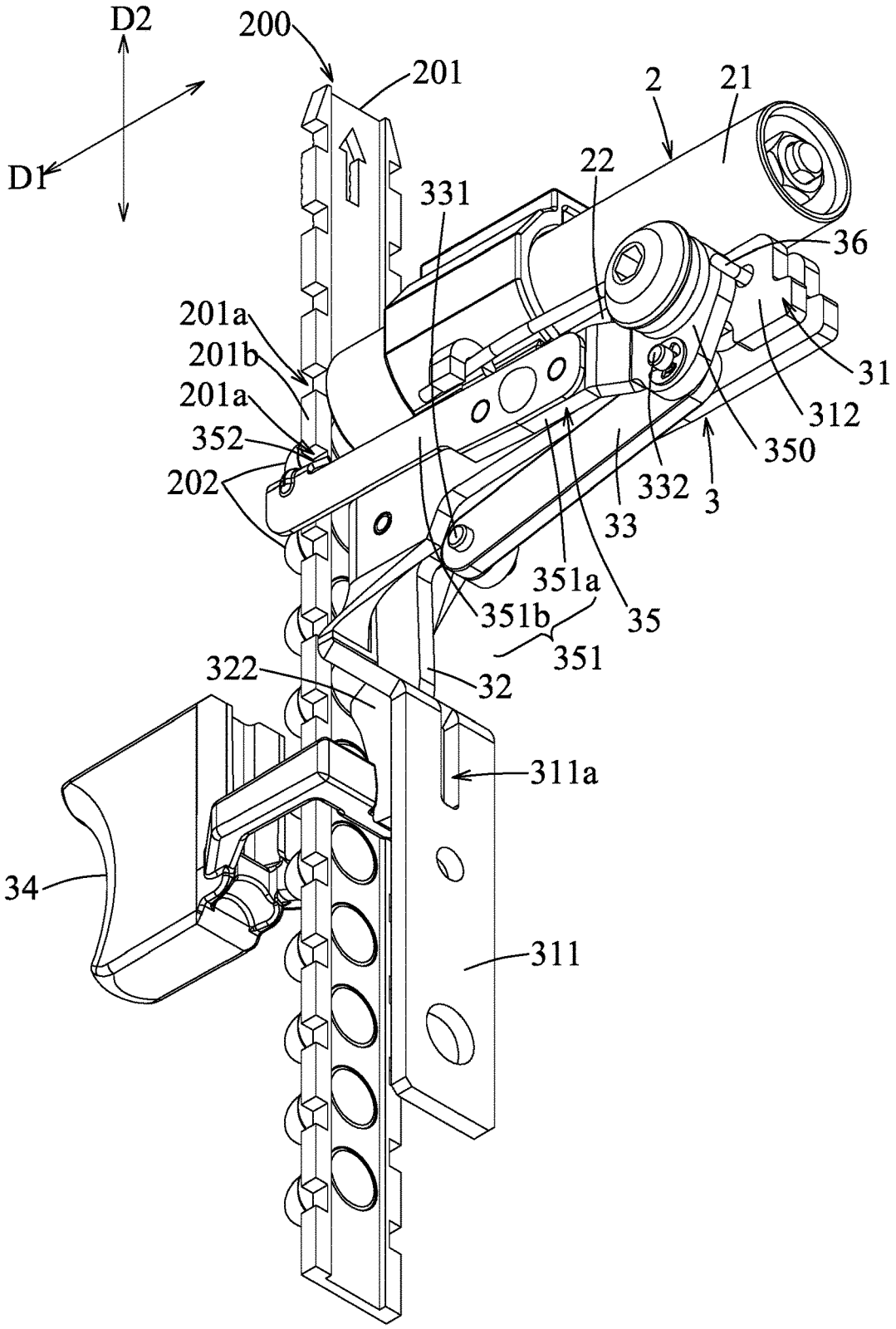
FIG. 6 is a perspective view of the firing module and the trigger and cartridge advancing module of the embodiment taken from another angle.

Referring to FIGS. 2, 4 and 6, the firing module 2 is disposed within the barrel section 11 of the tool housing 1 and located rearwardly of the firing position 131. Specifically, the firing module 2 has a firing pin sleeve 21 disposed rearwardly of the firing position 131, a firing pin (not shown) received in the firing pin sleeve 21 and movable forwardly to cause the cartridge 202 in the firing position 131 to explode for releasing its entire force, a firing biasing spring (not shown) disposed between the firing pin and the firing pin sleeve 21 to bias the movement of the firing pin, and a sear pin 22 extending downwardly from the firing pin sleeve 21 to actuate the firing pin.

The trigger and cartridge advancing module 3 is disposed within the tool housing 1, and includes a mounting frame 31 disposed securely within the tool housing 1, an L-shaped trigger lever 32 pivotably attached to the mounting frame 31, a cartridge advancing lever 35 pivotably attached to the mounting frame 31, a link bar 33 pivotably connected between the trigger lever 32 and the cartridge advancing lever 35, a trigger 34 and a biasing returning member 36. The mounting frame 31 is generally of an L-shape, and has an upright mounting wall 311 extending in the upright direction (D2) and securely disposed within the grip section 12 of the tool housing 1, and an extending wall 312 securely disposed within the barrel section 11 and extending rearwardly from an upper portion of the upright mounting wall 311. The trigger lever 32 and the cartridge advancing lever 35 are pivotably attached to the extending wall 312 of the mounting frame 31. With the mounting wall 311 of the mounting frame 31 securely disposed within the grip section 12 which is subjected to less impact than that in the barrel section 11, the structural strength of the mounting frame 31 is not adversely influenced by impact during the fastener striking process.

The trigger lever 32 has a sear-engage end 321 close to the sear pin 22, and a trigger-engage end 322 close to the trigger 34. The trigger 34 is disposed to be pulled to engage the trigger-engage end 322 to turn the trigger lever 32 such that the sear-engage end 321 is moved upwardly to drive the sear pin 22 so as to actuate the firing pin to strike the cartridge 202 in the firing position 131 to explode the cartridge 202.

The cartridge advancing lever 35 has a strip-engage end 352 which is turnable to be engaged in the strip accommodation channel 13 to be fitted to one of the side notches (201*a*) that corresponds to the cartridge 202 in the firing position 131. In this embodiment, the cartridge advancing lever 35 is pivotably attached to the extending wall 312. At the time that the trigger lever 32 is turned to actuate the firing process, through the link bar 33 connected between the trigger lever 32 and the cartridge advancing lever 35 with first and second pivot points 331, 332, respectively, the cartridge advancing lever 35 is turned so as to move the strip-engage end 352 to engage with a next one of the side notches (201*a*) that corresponds to the next cartridge 202.

The biasing returning member 36 is in the form of a torsion spring in this embodiment, and has two ends respectively abutting against the extending wall 312 and the cartridge advancing lever 35 to bias the cartridge advancing lever 35, the link bar 33, the trigger lever 32, and the trigger 34 to return to their original positions once the pulling action to the trigger 34 is released. Alternatively, the biasing returning member 36 may be connected between the mounting frame 31 and the trigger lever 32.

Figure 7:
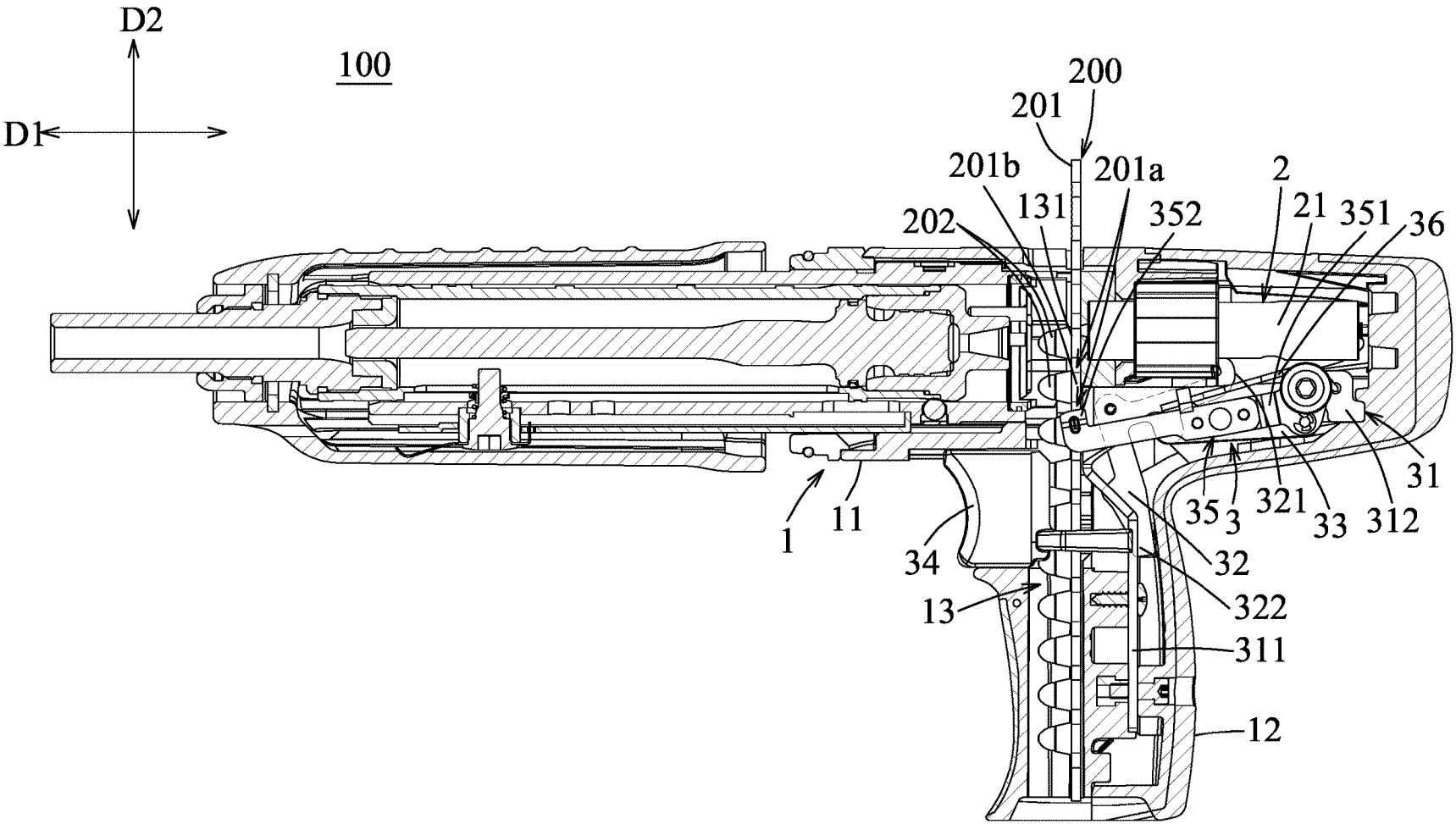
FIG. 7 is a partly sectional view illustrating the embodiment in a firing state.
Figure 8:
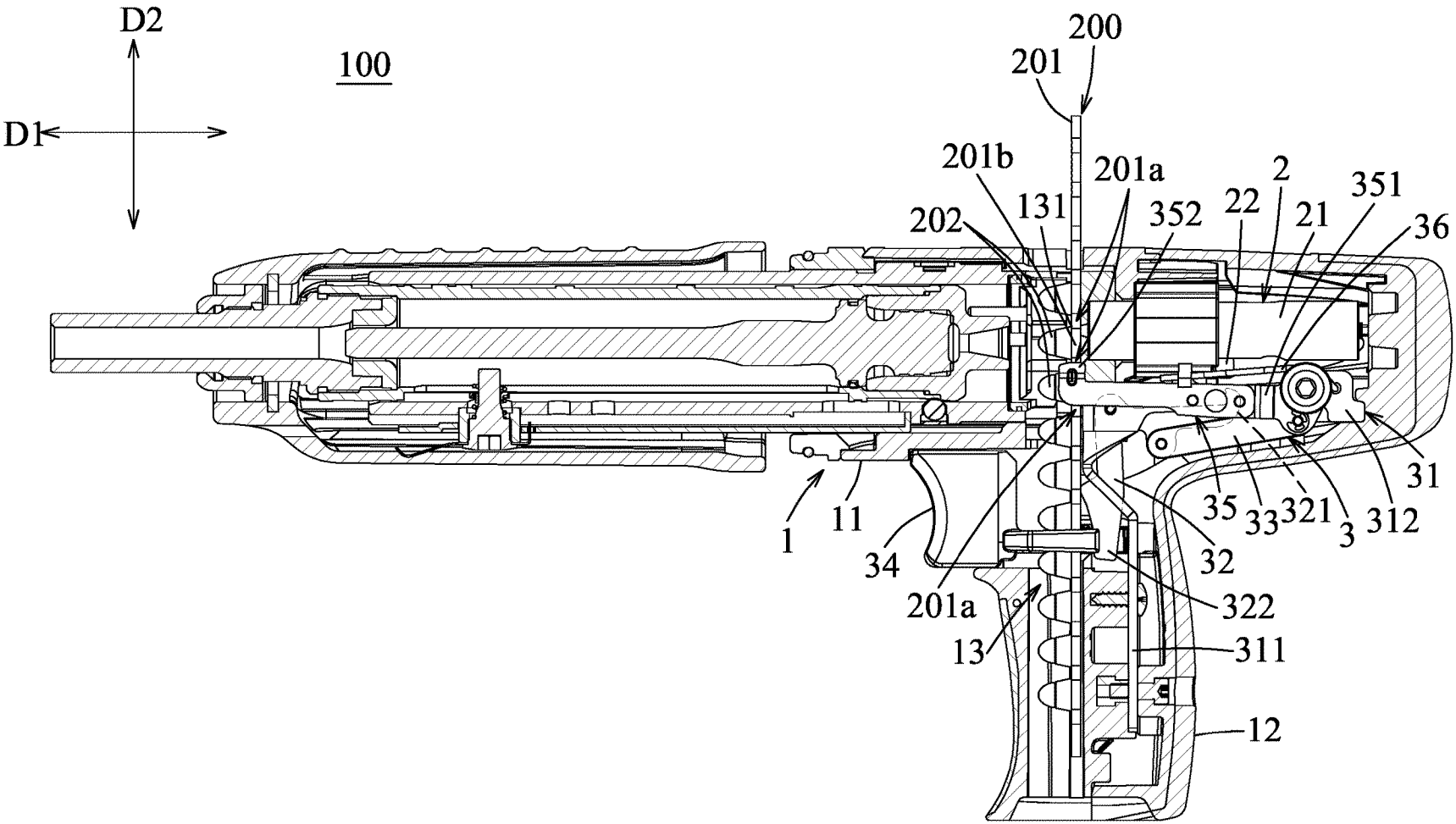
FIG. 8 is a partly sectional view illustrating the embodiment in a returning state.

With reference to FIGS. 4, 5, 7 and 8, in this embodiment, the cartridge advancing lever 35 is made of metal material, and has a lever body 351 which has a fulcrum end 350 pivotably attached to the mounting frame 31 and which extends forwardly from the fulcrum end 350 to terminate at a strip-engage end 352. The strip-engage end 352 is in the form of an engaging plate which is inclined upwardly and toward the strip body 201 so as to facilitate engagement in one of the side notches (201*a*) corresponding with the cartridge 202 in the firing position. As shown in FIG. 7, when the trigger 34 is pulled to press the trigger-engage end 322 of the trigger lever 32 rearward, the sear-engage end 321 is moved to press the striking pin 22 upward so as to actuate the firing pin forwardly to strike the cartridge 202 in the firing position 131. At this time, the cartridge advancing lever 35 is turned downwardly such that an inward surface 3521 of the strip-engage end (engaging plate) 352, which faces a side of the strip body 201, is resiliently slided along and over the side portion (201*b*) of the strip body 201 between two of the side notches (201*a*) and is then biased and engages in the next one of the side notches (201*a*) that corresponds to the next cartridge 202. As shown in FIG. 8, when the pulling action of the trigger 34 is released, the cartridge advancing lever 35 is turned upwardly back to its original position by means of the biasing returning member 36. During returning of the cartridge advancing lever 35, the strip-engage end (the engaging plate) 352 and the strip 200 are moved upward and advancing so as to move the next cartridge 202 to the firing position 131.

Figure 5:
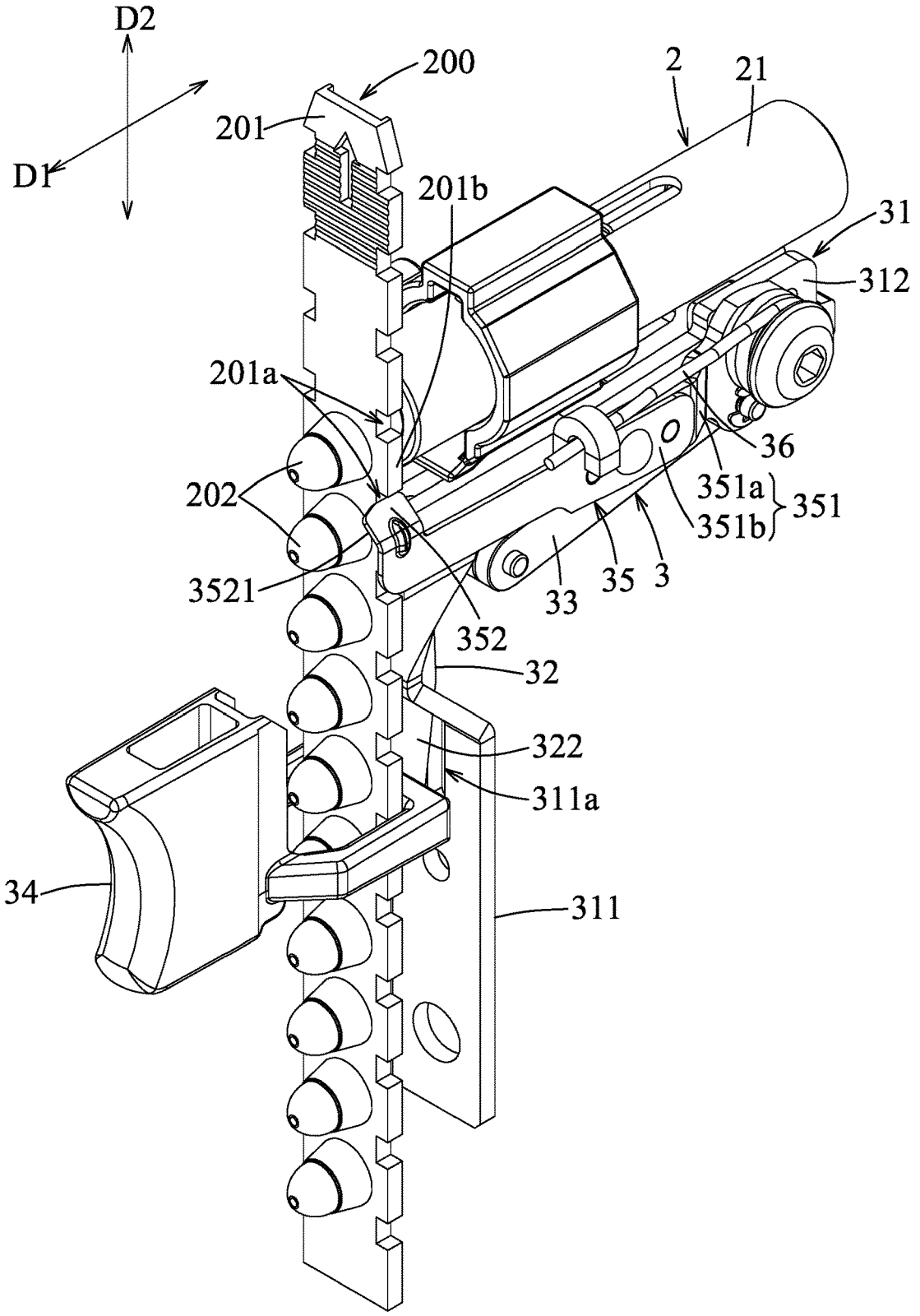
FIG. 5 is a perspective view of a firing module and a trigger and cartridge advancing module of the embodiment.

Moreover, referring to FIGS. 4 to 6, in this embodiment, the lever body 351 has a primary metal plate (351*a*) which has the fulcrum end 350 pivotably attached to the mounting frame 31 and which extends forwardly, and an extending metal plate (351*b*) which extends forwardly from the primary metal plate (351*a*) to terminate at the strip-engage end 352. The strip-engage end 352 is integrally formed with the extending metal plate (351*b*). The extending metal plate (351*b*) has a thickness smaller than that of the primary metal plate (351*a*). The lever body 351 has the primary metal plate (351*a*) with a larger thickness to render the structural strength enhanced, and the engaging plate 352 has a smaller thickness to resiliently slide over the side portion (201*b*). Furthermore, the primary metal plate (351*a*) and the extending metal plate (351*b*) are connected securely in a rivet manner or the like.

In this embodiment, the upright mounting wall 311 of the mounting frame 31 has a guideway (311*a*) which penetrates in the front-and-rear direction (D1) and which is elongated in the upright direction (D2). The trigger lever 32 has a guided portion which is fittingly extended through the guideway (311*a*) to avoid lateral deviation of the trigger lever 32 (in a left-and-right direction) so as to stabilize the turning of the trigger lever 32.

With the cartridge advancing lever 35 pivotably attached to the stable mounting frame 31 and mechanically linked with the trigger lever 32 through the link bar 33, during the firing process of the firing module 2 for detonating the cartridge 200 in the firing position 131, the cartridge advancing lever 35 can be moved with the trigger lever 32 so that the next cartridge 200 is moved to the firing position 131 to complete the load advancing function. Hence, the deviation of the cartridge advancing lever 35 in the upright direction (D2) is stably controlled, as compared with the prior art in which the deviation of the load advancer is high due to the clearance between the external sleeve and the inner tube as well as the long push rod. Moreover, the turning of the trigger lever 32 is guided by the guideway (311*a*) to be stabilized so as to stabilize the movement of the cartridge advancing lever 35 to avoid the movement thereof in a lateral direction that is transverse to both the front-and-rear direction (D1) and the upright direction (D2). Thus, with the stable control of the movement of the cartridge advancing lever 35, the engaging position and depth of the strip-engage end 352 in the side notch (201*a*) can be optimally controlled so as to avoid malfunction of and improper cartridge advancing of the cartridge advancing lever 35.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An explosive discharge actuated tool used with a multi-cartridge strip for driving fasteners, the multi-cartridge strip including a strip body and multiple cartridges loaded on the strip body, the strip body having multiple side notches respectively corresponding to the cartridges, said explosive discharge actuated tool comprising:

a tool housing having a strip accommodation channel which extends in an upright direction for accommodating the strip, said strip accommodation channel having a firing position where a cartridge to be detonated is loaded;

a firing module disposed within said tool housing and located rearwardly of said firing position; and a trigger and cartridge advancing module including a mounting frame disposed securely within said tool housing, a trigger lever pivotably attached to said mounting frame, a cartridge advancing lever pivotably attached to said mounting frame and having a strip-engage end which is turnable to be fitted to one of the side notches that corresponds to the cartridge in said firing position, a link bar pivotably connected between said trigger lever and said cartridge advancing lever such that turning of said trigger lever causes turning of said cartridge advancing lever, a trigger disposed to be pulled to turn said trigger lever to drive said firing module into the cartridge in said firing position and, through said link bar, to turn said cartridge advancing lever so as to move said strip-engage end to engage with a next one of the side notches that corresponds to the next cartridge, and a biasing returning member disposed to bias said cartridge advancing lever, said link bar, said trigger lever and said trigger to return to their original positions, and to result in, during returning of said cartridge advancing lever, an upward and advancing movement of said strip-engage end and the strip so as to move the next cartridge to said firing position;

said mounting frame having a guideway which penetrates in a front-and-rear direction that is transverse to the upright direction and which is elongated in the upright direction, said trigger lever having a guided portion which is fittingly extended through said guideway to stabilize the turning of said trigger lever.

2. The explosive discharge actuated tool as claimed in claim 1, wherein said tool housing has a main tube section extending in the front-and-rear direction, and a grip section extending downwardly from a bottom portion of said main tube section, said mounting frame having an upright mounting wall which is securely disposed within said grip section, and an extending wall which is securely disposed within said barrel section and extends rearwardly from an upper portion of said upright mounting wall, both said trigger lever and said cartridge advancing lever being pivotably mounted on said extending wall.

3. The explosive discharge actuated tool as claimed in claim 2, wherein said biasing returning member is a torsion spring which has two ends respectively abutting against said extending wall and said cartridge advancing lever.

4. The explosive discharge actuated tool as claimed in claim 1, wherein said cartridge advancing lever has a lever body which has a fulcrum end pivotably attached to said mounting frame and which extends forwardly from said fulcrum end to terminate at said strip-engage end, said strip-engage end being in the form of an engaging plate which is inclined upwardly and toward the strip body so as to facilitate engagement in one of the side notches.

5. The explosive discharge actuated tool as claimed in claim 4, wherein said strip-engage end has an inward surface which faces a side of the strip body and which is slidable along the side of the strip body during turning of said cartridge advancing lever, so as to be biased into the next one of the side notches in returning of said cartridge advancing lever by said biasing returning member.

6. The explosive discharge actuated tool as claimed in claim 4, wherein said lever body has a primary metal plate which has said fulcrum end pivotably attached to said mounting frame and which extends forwardly, and an extending metal plate which extends forwardly from said primary metal plate to terminate at said strip-engage end, said engaging plate, which is said strip-engage end, being integrally formed with said extending metal plate, said extending metal plate having a thickness smaller than that of said primary metal plate.

* * * * *